US009559453B1

(12) United States Patent
Luo

(10) Patent No.: US 9,559,453 B1
(45) Date of Patent: Jan. 31, 2017

(54) HEAVY CURRENT MINI CONNECTOR

(71) Applicant: Amphenol East Asia Electronic Technology (Shen Zhen) Co., Ltd., Shenzhen (CN)

(72) Inventor: Yiqiang Luo, Shenzhen (CN)

(73) Assignee: Amphenol East Asia Electronic Technology (Shen Zhen) Co., Ltd., Shenzhen (CN)

( * ) Notice: Subject to any disclaimer, the term of this patent is extended or adjusted under 35 U.S.C. 154(b) by 0 days.

(21) Appl. No.: 15/146,064

(22) Filed: May 4, 2016

(51) Int. Cl.

| | |
|---|---|
| ***H01R 12/00*** | (2006.01) |
| ***H01R 13/428*** | (2006.01) |
| ***H01R 12/70*** | (2011.01) |
| ***H01R 13/53*** | (2006.01) |
| ***H01R 12/57*** | (2011.01) |

(52) U.S. Cl.
CPC ..... *H01R 13/428* (2013.01); *H01R 12/57* (2013.01); *H01R 12/707* (2013.01); *H01R 12/7047* (2013.01); *H01R 13/53* (2013.01)

(58) Field of Classification Search
CPC ... H01R 12/57; H01R 12/707; H01R 12/7047; H01R 13/53; H01R 13/428
USPC ..... 439/78, 83, 595, 857, 862, 947
See application file for complete search history.

(56) References Cited

U.S. PATENT DOCUMENTS

| | | | | |
|---|---|---|---|---|
| 6,764,349 | B2 * | 7/2004 | Provencher | H01R 13/6587 439/607.05 |
| 7,628,661 | B2 * | 12/2009 | Liao | H01R 12/57 439/862 |
| 8,047,857 | B1 * | 11/2011 | Lu | H01R 12/714 439/500 |
| 9,033,750 | B2 * | 5/2015 | Miller | H01R 13/26 439/862 |
| 2009/0247023 | A1 * | 10/2009 | Liao | H01R 12/57 439/862 |

* cited by examiner

*Primary Examiner* — Khiem Nguyen
(74) *Attorney, Agent, or Firm* — Maier & Maier, PLLC

(57) ABSTRACT

A heavy current mini connector. The connector has a power terminal assembly and a holder. The power terminal assembly includes a set of resilient contacting tabs. The power terminal assembly and a busbar conductive plate are inserted into each other. The power terminal assembly is conductively connected with a PCB and covered on its outer side with the holder made from steel. The set of resilient contacting tabs is located at the front portion of the power terminal assembly and in contact with the busbar conductive plate. The clamping plates, fastened to the base and provided in the front of the holder, are clamped to the two sides of the power terminal assembly. The base is located on the rear of the holder and is clamped onto the outside of the rear part of the power terminal assembly. The ventilation apertures are situated on the middle of the base.

6 Claims, 3 Drawing Sheets

HEAVY CURRENT MINI CONNECTOR

TECHNICAL FIELD

The present application relates to the field of heavy current connector, particularly to a new heavy current mini connector.

BACKGROUND

Under the circumstance of heavy current, security becomes the premier standard for connector products. As an important aspect of connector security, the ability of anti-deflection plays a vital role in ensuring the security and durability of connector.

Nowadays, one of the defects of the heavy current connector in the prior art is that its adaptability, i.e. its tolerance to deflected plugging posture, is insufficient. Accurate plugging posture of such connector can eliminate various potential electric risks and improve the heat dissipation, plugging convenience and connecting reliability of the heavy current connector, so as to further enhance the connector's security.

SUMMARY OF THE APPLICATION

To solve the above mentioned technical problems, the present application provides a heavy current mini connector, which possesses a better tolerability to deflected plugging posture and improves plugging convenience and heat dissipation, thus enhancing the heavy current connector's security and practicability.

To be specific, the technical solutions of the present application provide a new heavy current mini connector comprising a power terminal assembly and a holder. The power terminal assembly includes a set of resilient contacting tabs.

The power terminal assembly and a busbar conductive plate are inserted to each other. The power terminal assembly is conductively connected with a PCB and covered on its outer side with the holder made from stainless steel.

The set of resilient contacting tabs is located at the front portion of the power terminal assembly and contacted with the busbar conductive plate.

The holder includes clamping plates, a base and at least one ventilation aperture.

The clamping plates, which are fastened to the base and provided in the front portion of the holder, tightly clamp to the two sides of the power terminal assembly.

The base is located at the rear portion of the holder and is clamped onto the outside of the rear part of the power terminal assembly.

The ventilation aperture(s) is(are) disposed on the middle portion of the base.

In a further optimized technical solution, the new heavy current mini connector comprises a housing covered onto the outer sides of the power terminal assembly and the holder.

In a further optimized technical solution, the set of resilient contacting tabs includes at least five separate resilient contacting tabs.

In a further optimized technical solution, each resilient contacting tab is provided on its inner contact side with a first contacting point and a second contacting point.

In a further optimized technical solution, the power terminal assembly includes welding PCB interfaces. The welding PCB interfaces are located on the outer sides of the rear portion of the power terminal assembly and may be conductively connected with the PCB by means of welding.

In a further optimized technical solution, the power terminal assembly includes threaded PCB interfaces. The threaded PCB interfaces are located on the outer side of the rear portion of the power terminal assembly and can be conductively connected with the PCB through bolts.

Several beneficial effects are achieved by the present application thanks to the employment of the above technical solutions. Specifically, compared with disclosed technical solutions of the heavy current connector in the art, 1) the connector in the technical solutions of present invention possesses better ability of heat dissipation, because there is(are) ventilation aperture(s) disposed on the middle portion of the base which is(are) favorable for the power terminal assembly to dissipate heat upon being fed with heavy current; 2) the connector can be hot plugged, because each resilient contacting tab is provided with a first contacting point and a second contacting point on its contact side; 3) the connector possesses reliable conductivity, because the set of resilient contacting tabs includes at least five separate resilient contacting tabs; in this way, at least five contact points are formed to avoid insufficient contact area caused by deflected insertion of the busbar conductive plates or other elements, so as to enhance electric conductivity of the final products.

DETAILED DESCRIPTION

The present application will be detailed in connection with FIGS. 1 to 3 and the specific embodiments, which are in no way intended to limit the present application.

Embodiment 1

Figure 1:
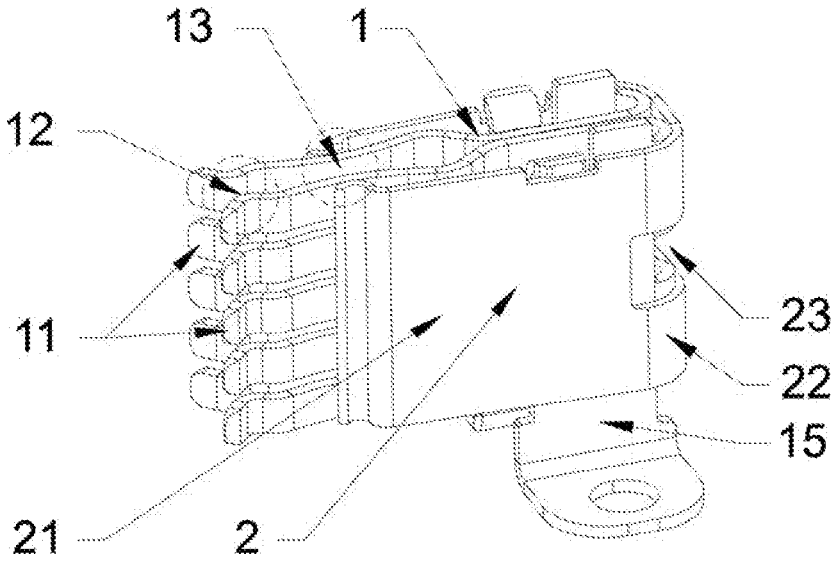
FIG. 1 is a perspective view of a new heavy current mini connector (screw type).
Figure 2:
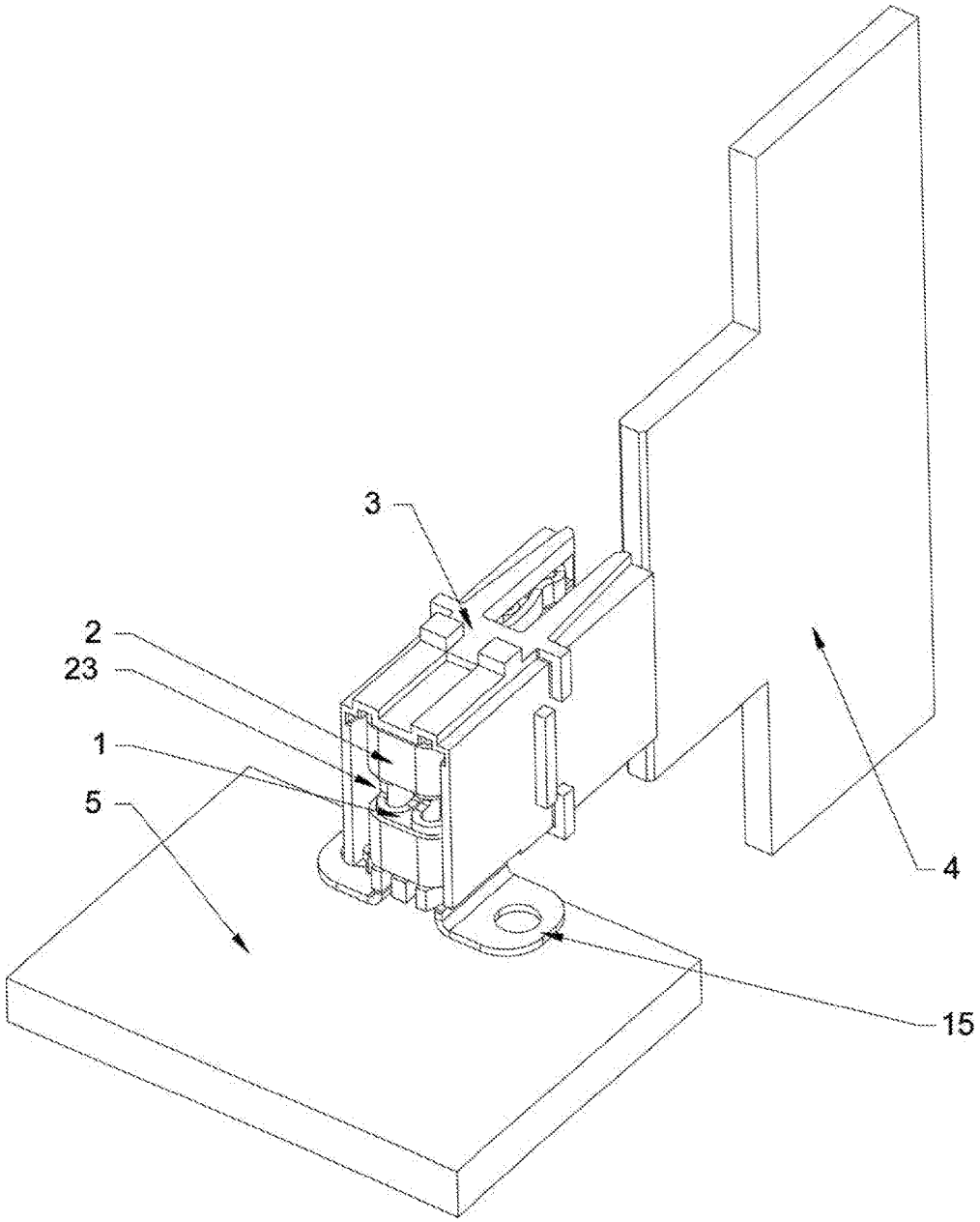
FIG. 2 is a perspective view of a new heavy current mini connector (screw type) showing using state.

As shown in FIGS. 1 and 2, a new screw-type heavy current mini connector comprises a power terminal assembly 1, a holder 2 and a housing 3. The power terminal assembly 1 includes a set of resilient contacting tabs 11.

The power terminal assembly 1 and a busbar conductive plate 4 are inserted to each other. The power terminal assembly is conductively connected with a PCB 5 and covered on its outer side with the holder 2 made of stainless steel.

The set of resilient contacting tabs 11, which includes at least five separate resilient contacting tabs, is located at the front portion of the power terminal assembly 1 and contacted with the busbar conductive plate 4.

Each resilient contacting tab is provided on its inner contact side with a first contacting point 12 and a second contacting point 13.

The power terminal assembly 1 is provided with threaded PCB interfaces 15 on the outer side of its rear portion and can be conductively connected with the PCB 5 through bolts threaded into the interfaces 15.

The holder 2 includes clamping plates 21, a base 22 and at least one ventilation aperture 23.

The clamping plates 21, which are fastened to the base 22 and provided in the front portion of the holder 2, tightly clamp to the two sides of the power terminal assembly 1.

The base 22 is located on the rear portion of the holder 2 and is clamped onto the outside of the rear part of the power terminal assembly 1.

The ventilation aperture(s) 23 is(are) disposed on the middle portion of the base 22.

The housing 3 is covered onto the outer sides of the power terminal assembly 1 and the holder 2.

Embodiment 2

Figure 3:
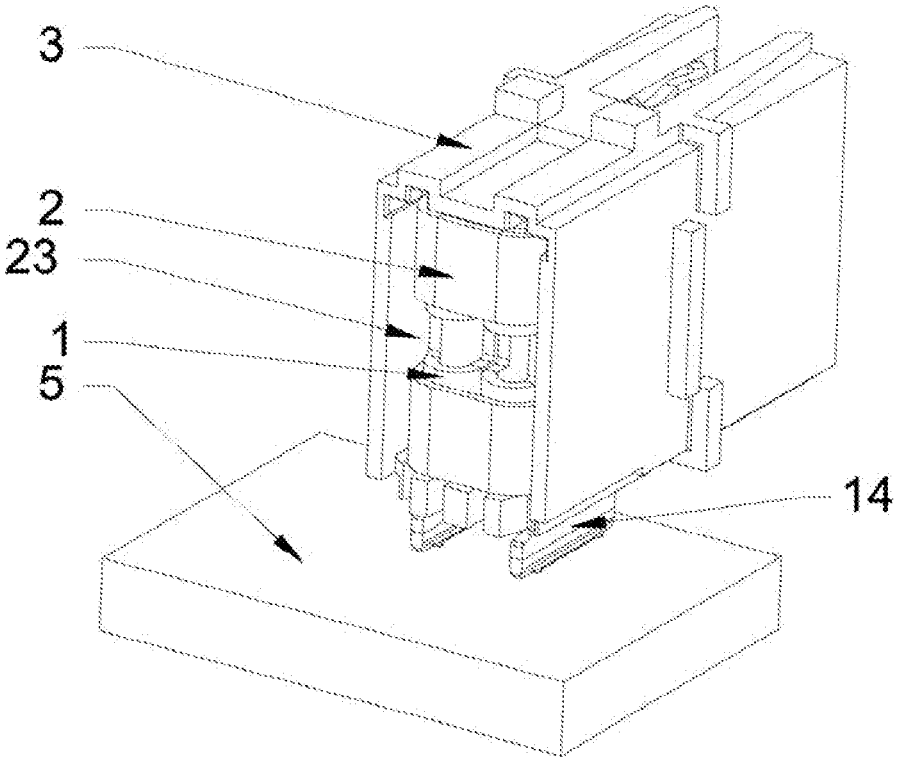
FIG. 3 is a perspective view of a new heavy current mini connector (welding type).

On the basis of above mentioned embodiments, as shown in FIG. 3, welding PCB interfaces 14 may replace the threaded PCB interfaces 15 of the power terminal assembly 1 and help form a welding-type heavy current mini connector.

The welding PCB interfaces 14 are located on the outer side of the rear portion of the power terminal assembly 1 and may be conductively connected with the PCB 5 by means of welding.

It is known from the general technical knowledge that the present technical solutions can be achieved by other embodiments which do not depart from the spiritual substance or essential features of the present invention. Therefore, the above mentioned embodiments, in various aspects, are merely illustrative rather than exclusive. All changes within the scope of the present application or the scope of its equivalent are intended to be included within the present application.

What is claimed is:

1. A new heavy current mini connector comprising: a power terminal assembly and a holder, the power terminal assembly including a set of resilient contacting tabs;

wherein a busbar conductive plate is inserted into the power terminal assembly; the power terminal assembly is conductively connected with a PCB and covered on its outer side with the holder which is made from stainless steel;

wherein the set of resilient contacting tabs is located at the front portion of the power terminal assembly and in contact with the busbar conductive plate;

wherein the holder includes clamping plates, a base and at least one ventilation aperture;

wherein the clamping plates, which are fastened to the base and provided in the front portion of the holder, tightly clamp to the two sides of the power terminal assembly;

wherein the base is located on the rear portion of the holder and is clamped onto the outside of the rear part of the power terminal assembly;

wherein the at least one ventilation aperture is disposed on the middle portion of the base.

2. The new heavy current mini connector as set forth in claim 1, wherein the connector further comprises a housing which is covered onto the outer sides of the power terminal assembly and the holder.

3. The new heavy current mini connector as set forth in claim 2, wherein the set of resilient contacting tabs includes at least five separate resilient contacting tabs.

4. The new heavy current mini connector as set forth in claim 3, wherein each resilient contacting tab is provided on its inner contact side with a first contacting point and a second contacting point.

5. The new heavy current mini connector as set forth in claim 4, wherein the power terminal assembly includes welding PCB interfaces which are located on the outer side of the rear portion of the power terminal assembly and may be conductively connected with the PCB by welding.

6. The new heavy current mini connector as set forth in claim 4, wherein the power terminal assembly includes threaded PCB interfaces which are located on the outer side of the rear portion of the power terminal assembly and can be conductively connected with the PCB through bolts.

* * * * *